United States Patent [19]

Kedzierski

[11] 4,065,021

[45] Dec. 27, 1977

[54] PAD AND DIVIDER COMBINATION

[76] Inventor: Elizabeth Kedzierski, 775 Austin Ave., Oradell, N.J. 07649

[21] Appl. No.: 736,609

[22] Filed: Oct. 28, 1976

[51] Int. Cl.[2] ..... A47B 88/12

[52] U.S. Cl. ..... 220/22; 217/33; 229/28 R; 312/209; 312/330 SM

[58] Field of Search ..... 312/209, 234.1, 330, 312/320; 224/28 R, 29 E; 217/31, 33; 220/22

[56] References Cited

U.S. PATENT DOCUMENTS

| | | | |
|---|---|---|---|
| 2,951,624 | 9/1960 | Schwebs | 229/28 R |
| 2,964,371 | 12/1960 | Todd et al. | 312/320 |
| 3,788,002 | 1/1974 | Suchka | 329/28 R |
| 3,817,588 | 6/1974 | Helmers | 312/234.1 |
| 3,851,940 | 12/1974 | Relyea | 312/209 |

*Primary Examiner*—Casmir A. Numberg
*Attorney, Agent, or Firm*—Howard J. Newby

[57] ABSTRACT

A pad and divider combination assembly defining a plurality of cells for insertion in a walled compartment readily erected from generally rectangular blanks of material suitably cut and scored for folding and interlocking and which is augmented with, and features, interchangeable indexing means for designating the contents intended for containment in the individual cells formed by the intersecting partitions of the assembly.

4 Claims, 9 Drawing Figures

FIG. 1.
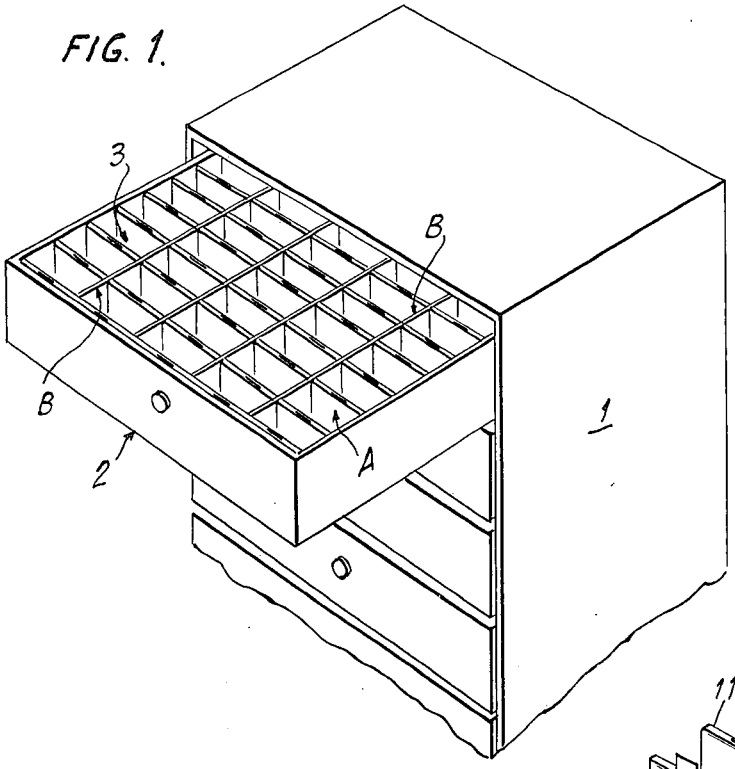
FIG. 9.
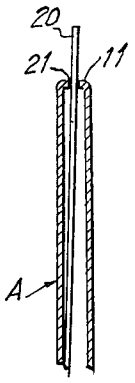
FIG. 8.
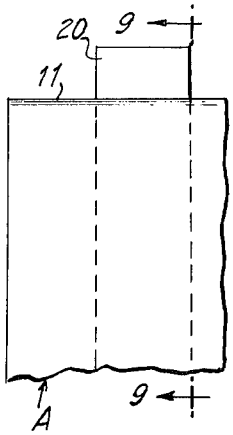
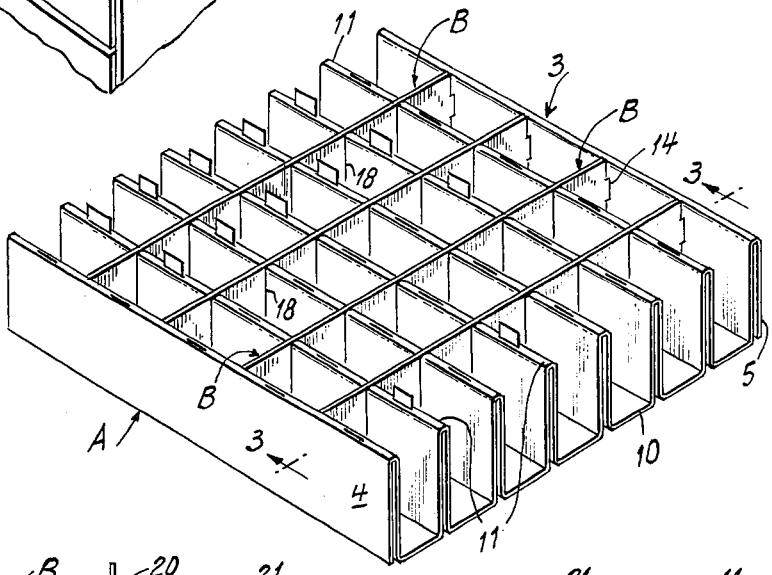
FIG. 2.
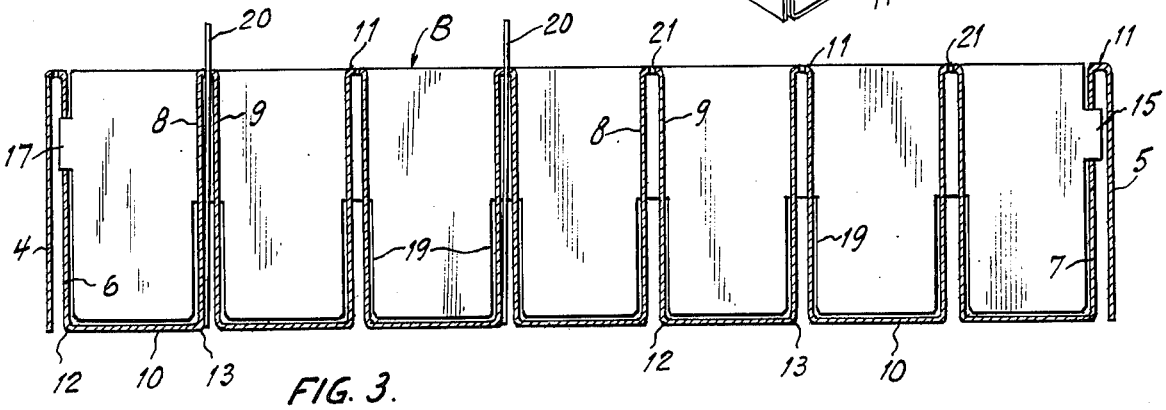
FIG. 3.

FIG. 4.
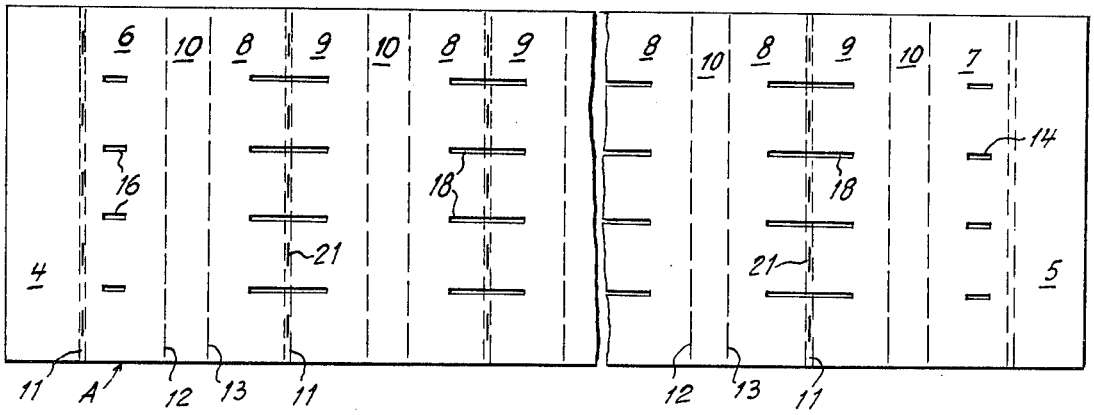
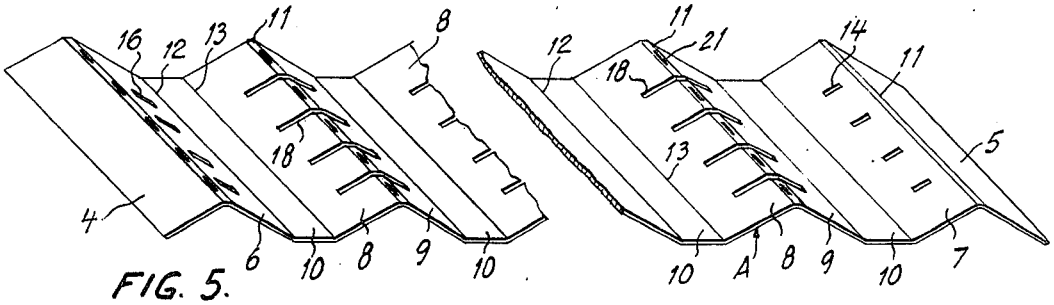
FIG. 5.
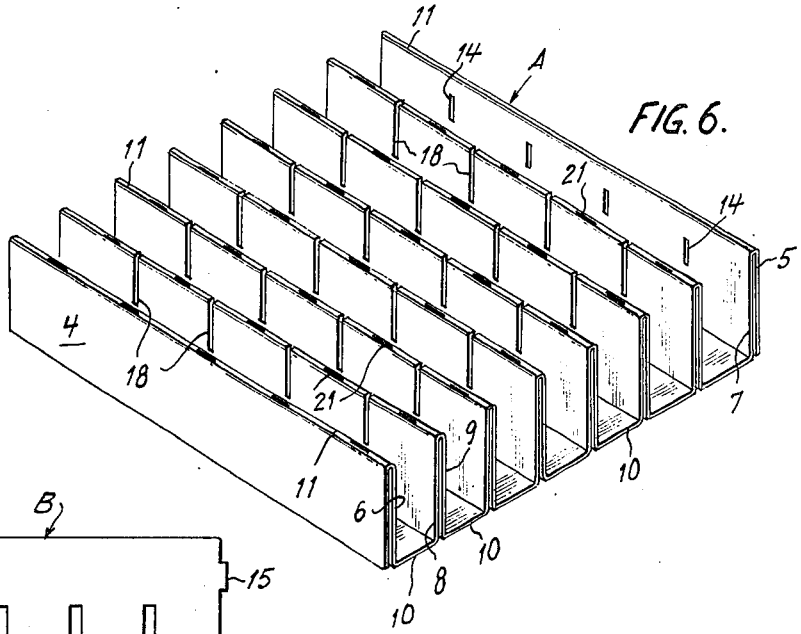
FIG. 6.
FIG. 7.
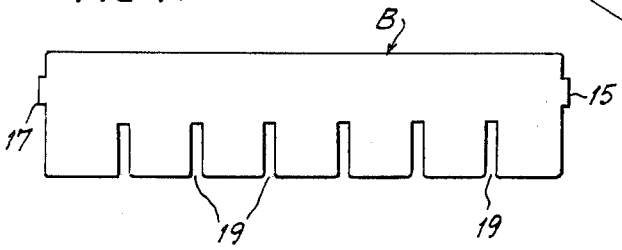

PAD AND DIVIDER COMBINATION

SUMMARY OF THE INVENTION

This invention relates to new and useful improvements in pad and divider combinations constructed of foldable material for receptacles and, in particular, is directed to a pad and divider assembly of the releasably engaging aperture and notched sheet-type for use in a walled compartment such as a dresser drawer.

The present invention comprehends a pad and divider combination which is easily erected from generally rectangular blanks of foldable material to form a multicell insert for a walled compartment. The pad and divider insert lends itself particularly to that of a useful accessory for household furniture and other storage facilities.

The pad and divider assembly of the invention is particularly suitable as a compatible accessory for economical fiberboard furniture, storage boxes, etc., which are manufactured and delivered to the purchaser in a "knocked-down" state in a relatively flat, space-conserving package; the pad and divider combination being adapted for assembly as readily as the furniture compartments into which it is intended to be inserted.

The pad and divider assembly features interchangeable indexing means for designating and identifying the articles intended for storage in the individual cells formed by the intersecting partitions of the assembly and, within its versatile utility, is particularly suitable for the filing, organized storage, and identification of small, delicate articles of feminine clothing.

It therefore becomes an object of the invention to provide a pad and divider assembly which can be readily assembled for use in a compartment such as a fiberboard furniture drawer, box, or similar container.

It is an object of the invention to provide a pad and divider assembly from blanks of sheets of foldable material, said sheets of material readily lending themselves to accompanying furniture drawers and/or cabinets packaged in a flat, "knocked-down" condition for space conserving purposes.

It is another object to provide a pad and divider assembly constructed from foldable material having smooth, pleasingly colored printed and/or embossed surfaces decorated to be compatible with feminine clothing for the storing and easy accessibility of such articles as panty hose, stockings, peds, handkerchiefs, etc.

It is yet another object of the pad and divider assembly to provide unique means of construction for labelling the intended contents of each cell of the multiplicity of cells in order to facilitate the categorizing and selection of specific individual like-appearing articles.

These and further objects of this invention and the attendant advantages will be readily apparent as the same becomes better understood by reference to the following detailed description.

The present invention, accordingly, consists in the features of construction, combination of elements and arrangement of parts which will be exemplified in the pad and divider assembly hereinafter described and of which the inventive scope will be indicated in the claims appended to the application.

BRIEF DESCRIPTION OF THE DRAWING

In the accompanying drawing, wherein like reference characters indicate like parts in the several figures;

FIG. 1 is a front partial perspective view of a chest of drawers showing an embodiment of the combination pad and divider assembly of the invention having 35 cells in place in the opened, uppermost drawer of the chest of drawers.

FIG. 2 is a perspective view of the assembled combination pad and divider of FIG. 1.

FIG. 3 is a transverse section, as seen in the plane indicated by the line 3—3 in FIG. 2 showing the interlocking of a transverse panel (FIG. 7) with an upstanding folded coplanar lateral panel of FIG. 6.

FIG. 4 is a broken top plan view of a blank adapted to be folded into the multiple pad sections and lateral coplanar panel structures of the assembly as shown in FIG. 6.

FIG. 5 is a broken perspective view of the partially folded blank of FIG. 4.

FIG. 6 is a perspective view of the completely folded blank of FIG. 4.

FIG. 7 is a side elevational view of a blank adapted to be inserted and interlocked as a transverse panel in the assembly as shown in FIG. 2.

FIG. 8 is an enlarged fragmentary, front elevational view of a dual coplanar lateral panel showing the removable indexing blank inserted between the coplanar panel walls.

FIG. 9 is a side elevational section view of a portion of the coplanar lateral panel shown in FIG. 8, taken along section line 9—9 in FIG. 8.

DESCRIPTION OF THE PREFERRED EMBODIMENT

As an exemplified embodiment, the invention contemplates the use of a pad and divider assembly, having 35 cells, as generally shown by the numeral 3 in FIG. 1 for subdividing a drawer compartment 2 of a chest of drawers 1 to define a plurality of compartments or cells therein.

The assembled pad and divider combination (FIG. 2) comprises a series of parallel coplanar lateral panels generally shown by the letter A interlocked with a series of parallel transverse panels B.

As can best be seen in FIGS. 4 and 5, the lateral coplanar panels or ribs and the pad sections are constructed from a rectangular blank A of paper board or similar sheet-like material which is scored or otherwise adapted to be folded along score lines 11, 12 and 13. As indicated in FIG. 5, the pad portion of the assembly and the lateral ribs having dual coplanar panels or walls are formed by crimping the blank shown in FIG. 4 along creases 11, 12 and 13 and folding it to form the pad or floor sections 10 and the upstanding intermediate duplex parallel lateral panels 8 and 9 and the two end coplanar panels (4 and 6) and (5 and 7); portions 4 and 5 of blank A forming the two outermost walls of the assembly.

The blank A, preferably having one side as a smooth glossy surface suitably colored, printed and/or embossed or otherwise decorated, is so crimped and folded such that this especially finished side is uppermost on the pad sections of the assembly.

As shown in FIGS. 4 and 5, the blank A has transverse cut-outs or slots 18 which, when the blank is folded to form the upstanding hinged-type intermediary dual coplanar lateral panels as shown in FIG. 6 convert to vertical cut-outs in the lateral panels to receive for insertion the transverse panels 2 as shown in FIG. 7 which have complimentary slots 19 which cooperate with the slots of the lateral coplanar panels of the assembly to effect joining and interlocking of the transverse panels with the lateral panels of the assembly when erection of the assembly takes place.

Further to the securing and interlocking of the lateral and transverse panels, the two sections (6 and 7) of the blank A adjacent the two end wall sections (4 and 5) of the blank have suitable transverse cut-outs (14 and 16) which, when the blank is folded, as previously described, receive the end tabs (15 and 17) of the transverse panel B thereby further securing and interlocking the transverse and lateral panels as is best shown in FIG. 3.

The transverse panel B can be especially finished on both sides to lend attractiveness to the assembly or, although somewhat more costly, can be comprised of a double thickness of a single sheet completely folded along a line defining its uppermost edge thus having the especially finished side of the folded sheet appropriately exposed.

Further to the construction of the pad and divider combination, a unique interchangeable indexing accessory is provided for labelling the intended content of each cell. As shown, particularly in FIGS. 3 and 4, score lines 11 are parallel and in close proximity to each other such that, upon crimping and folding blank A along these score lines there is formed a substantially flat horizontal hinge-folded section at the top of each of the dual coplanar lateral panels holding the wall sections of each panel parallel to close proximity spaced relationship. The referred-to hinge-folded section is of sufficient width to accommodate a series of lateral slots 21 in spaced relationship to each other and to those of the traverse slots. The lateral cut-outs or slots 21 are of sufficient size to receive a substantially rectangular blank 20 as best illustrated in FIGS. 8 and 9.

The blank 20, removably insertable in the slots 21 is supported in a substantially vertical position interposed between the walls of the upstanding coplanar lateral panels by the floor of the compartment into which the erected pad and divider assembly is placed and by the wall defining the slot in the horizontal surface forming the top of the lateral panel section. The blank 20 is of sufficient dimension in length to extend above the upper horizontal surface of the lateral panel as indicated in FIGS. 8 and 9, thereby exposing a portion of the blank for the purpose of printing or otherwise marking the blank within the exposed area to indicate the contents of the cell immediately behind the so-positioned indicia blank.

The indexing structure of the assembly thus provides for readily interchanging blanks for corresponding cells and, as can be readily appreciated, provides four selective exposed surfaces of each blank for alternative indicia by reorienting the blank back-to-front and/or top-to-bottom.

Furthermore, and as shown in FIG. 9, the indexing blank may be positioned in a slightly slanted orientation due to the spacial arrangement of the coplanar lateral panel walls and, when in this slanted position, provides for better viewing of the indicia on the exposed portion of the blank facing the viewer.

As previously mentioned in connection with the transverse panel, the index blanks 20 may also be especially finished on both sides or alternatively be of a folded double thickness construction of a single sheet. In addition, the indicia blanks can be constructed to have smoothly rounded corners and edges to minimize the potential snagging of delicate clothing as it is being placed or removed from its designated cell.

The blanks for forming the pad sections, lateral and transverse panels and the indexing blanks of the described assembly may be of any conventional fiberboard suitable for die cutting, scoring and crimping, thus permitting mass production of the components of the structure. By way of example, a threeply bristol board is suitable and the board can be suitably colored and decorated by printing and/or embossing to further enhance the attractiveness of the assembled pad and divider combination.

It thus will be seen that a pad and divider assembly has been provided which achieves the several objectives of the invention and which is well adapted to meet the conditions of practical use.

As various possible additional embodiments might be made of the invention, and as various changes might be made in the embodiment set forth, it is to be understood that all matter herein described or shown in the accompanying drawing is to be interpreted as illustrative and not in a limiting sense.

What is claimed as new and desired to be secured by Letters Patent is:

1. A pad and divider of the releasably engaging aperture and notched sheet-type constructed from cut and scored fiberboard or the like and forming partitions intersecting at right angles for dividing a walled container into a plurality of rectangular indexed compartments, said pad and divider comprising;

a. a plurality of suitably cut substantially rectangular blanks forming a series of transverse panels, said transverse panels having vertical slots therein communicating with their lower edges, b. a substantially rectangular blank suitably cut and scored and folded forming a pad of smaller area than the blank area and a series of parallel lateral upstanding dual coplanar panels hinge-folded at their upper edges, said coplanar panels having spacially related lateral slots within said hinge-folds and having vertical slots therein communicating with the hinge-folded edges, said vertical slots interengaging the slots of the transverse panels and interlocking the transverse and coplanar panels at the points of intersection, and c. indexing means for the compartments of the pad and divider consisting of a plurality of substantially rectangular blanks removably interposed between the walls of the coplanar panels and protruding upwardly through the lateral spacially related slots in the hinge-folded upper edge of said panels to provide an exposed section of blank of sufficient area for accepting indicia.

2. The pad and divider of claim 1 wherein the indexing blanks are interchangeable in the lateral slots of the hinge-folded upper edge of the coplanar panels.

3. The interchangeable indexing blank of claim 2 wherein the blank is provided, upon reorienting the blank front-to-back and/or top-to-bottom, with four alternate exposed viewing areas having indicia thereon.

4. The pad and divider of claim 1 wherein the exposed surfaces are smooth and are pleasingly colored and otherwise decorated compatible with feminine articles of clothing.

* * * * *